US006410913B1

(12) United States Patent
Brekenfeld et al.

(10) Patent No.: US 6,410,913 B1
(45) Date of Patent: Jun. 25, 2002

(54) FRAGMENTATION IN QUADRUPOLE ION TRAP MASS SPECTROMETERS

(75) Inventors: Andreas Brekenfeld; Michael Schubert; Jochen Franzen, all of Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 09/613,614

(22) Filed: Jul. 11, 2000

(30) Foreign Application Priority Data

Jul. 14, 1999 (DE) ..... 199 32 839

(51) Int. Cl.[7] ..... H01J 49/42
(52) U.S. Cl. ..... 250/282; 250/292
(58) Field of Search ..... 250/281, 282, 250/283, 292

(56) References Cited

U.S. PATENT DOCUMENTS

| | | | | | |
|---|---|---|---|---|---|
| 4,736,101 | A | * | 4/1988 | Syka et al. | 250/292 |
| 4,761,545 | A | | 8/1988 | Marshall et al. | |
| 4,818,869 | A | * | 4/1989 | Weber-Grabau | 250/282 |
| 5,128,542 | A | | 7/1992 | Yates et al. | |
| 5,200,613 | A | * | 4/1993 | Kelley | 250/282 |
| 5,285,063 | A | * | 2/1994 | Schwartz et al. | 250/282 |
| 5,298,746 | A | * | 3/1994 | Franzen et al. | 250/292 |
| 5,347,127 | A | * | 9/1994 | Franzen | 250/292 |
| 5,381,006 | A | * | 1/1995 | Wells et al. | 250/282 |
| 5,404,011 | A | * | 4/1995 | Wells et al. | 250/282 |
| 5,517,025 | A | * | 5/1996 | Wells et al. | 250/282 |
| 5,528,031 | A | * | 6/1996 | Franzen | 250/282 |
| 5,654,542 | A | * | 8/1997 | Schubert et al. | 250/282 |
| 5,679,951 | A | | 10/1997 | Kelley et al. | |
| 6,015,972 | A | * | 1/2000 | Hager | 250/282 |
| 6,259,091 | B1 | * | 7/2001 | Eiden et al. | 250/281 |

FOREIGN PATENT DOCUMENTS

| | | | | |
|---|---|---|---|---|
| DE | 43 16 737 C1 | | 1/1994 | |
| DE | 44 25 384 C1 | | 2/1995 | |
| DE | 195 01 835 A1 | | 7/1996 | |
| EP | 0 575 777 A2 | * | 12/1993 | H01J/49/00 |
| EP | 0 643 415 A2 | * | 3/1995 | H01J/49/42 |
| GB | 2 278 233 A | | 11/1994 | |
| GB | 2 291 534 A | | 1/1996 | |

OTHER PUBLICATIONS

P. Liere et al.; Influence of Ion Activation and Thermalization Effects on Reaction Rate Constants in a Quadrupole Ion Trap Mass Spectrometer; International Journal of Mass Spectrometry and Ion Processes; 167/168 (1997); pps. 735–751.

* cited by examiner

*Primary Examiner*—Kiet T. Nguyen

(57) ABSTRACT

The invention relates to the fragmentation of ions in ion traps filled with collision gas by exciting their axial oscillations in a dipole-shaped excitation field with a frequency mixture which covers the frequency of ion oscillations. The invention consists of ramping up the voltages of the frequency mixture for the dipolar excitation field, as a result of which, surprisingly, approximately the same fragmentation results are obtained for ions of different structures in the same fragmentation times as at a structurally specific optimal voltage applied at a constant level.

13 Claims, 3 Drawing Sheets

FRAGMENTATION IN QUADRUPOLE ION TRAP MASS SPECTROMETERS

The invention relates to the fragmentation of parent ions in ion traps filled with collision gas by exciting their axial oscillations in a dipolar excitation field with a frequency mixture which covers the oscillation frequencies of the parent ions.

The invention consists of ramping up the voltages of the frequency mixture for the dipolar excitation field, resulting in, surprisingly, approximately the same fragmentation in the same fragmentation times as with optimal voltage applied at a constant level, even for parent ions of different structures needing structurally specific fragmentation voltages.

PRIOR ART

Fragmentation of ions is necessary if daughter ion spectra have to be acquired. Daughter ions are nothing but charged fragments of the parent ions which result from them due to disintegration when energy is supplied into the ions.

The supplied energy can be radiation energy for instance; a new method here is BIRD="Blackbody Infrared Radiation Dissociation", which, however, only works in the case of large molecular ions and requires a considerable amount of apparatus. Generally the energy can be much more simply introduced to the ions by impact with a collision gas (abbreviated to CID="Collisionally Induced Dissociation"; sometimes also called CAD="Collisionally Activated Dissociation").

Between two mass spectrometers arranged in series at a distance from each other one can shoot the ions through a cell containing collision gas between the spectrometers at relatively high levels of energy and then individual collisions already lead to spontaneous fragmentation. The daughter ions only lose a small amount of velocity; they can be fragmented into granddaughter ions in the same cell by another impact, and so on; these high-energy daughter ion spectra appear very different from low-energy daughter ion spectra due to the large number of descendant fragment ions.

In ion traps the ions cannot be accelerated such that an individual impact is sufficient for a fragmentation. By exciting the oscillations in the quasi potential well internal energy must be collected from a large number of low energy impacts until the ion ultimately breaks. Fractures are no longer spontaneous: the collected energy is statistically distributed over the entire ion, over all the possible oscillation states of the inner structure, and drifts to and fro inside of the ion due to coupled oscillations, until, due to random superimposition, a bond with low bonding energy collects sufficient energy for fracture.

The daughter ions have a different mass and thus a different oscillation frequency in the ion trap so they are no longer excited by the excitation frequency; on the contrary, they are cooled and decelerated by further impacts in the collision gas. Consequently, further granddaughter ions are not formed immediately; the spectra are pure daughter ion spectra.

Scanning granddaughter ion spectra calls for a two-stage fragmentation process: generation of initial substance ions, isolation of the selected parent ion type, fragmentation to form daughter ions, isolation of a selected daughter ion type, fragmentation to form granddaughter ions, and scanning the granddaughter ion spectrum. At the beginning of the process the ion trap has to be filled with sufficient ions - overloading generally causes no damage. Scanning great granddaughter spectra requires another intermediate step of isolation and fragmentation. Further descendant spectra can be scanned, the only prerequisite being that at the start the ion trap contains sufficient initial ions of the substance. The necessary filling can, from a series of spectra, be calculated by the method described in GB 2 322 961 (U.S. Pat. No. 5,936,241) and controlled. Commercially available ion traps permit generation of descendant spectra up to the tenth generation and above.

These non spontaneous fractures of the ions in ion traps are particularly informative about their structure because, firstly, they clearly relate to the bonds with the lowest levels of bonding energy and, secondly, because they indicate the relationship between the daughter and the mother. In high-energy impacts the relationship between the great granddaughter and the granddaughter, and also between the daughter and the mother, can no longer be read off in a simple manner. Only by complex methods of marking with enriched isotopes can the path of fraction and therefore the possible structure of the ion be clearly described.

Measurement of all the main daughter, granddaughter, and great granddaughter spectra in an ion trap therefore ideally reflects the fragmentation path and is of inestimable value in determining the structure and identity of the initial ion. Automatic measurement of all these ion spectra is desirable, but at the moment it is not practicable. It would be optimal if this automatic measurement could also be performed in the short time which is available in a separation of substances of a mixture, by liquid chromatography, for example, i.e. in about ten seconds.

The quantity of energy for fragmentation is, however, dependent on the structure of the ions. There are ion structures which already allow fragmentation by minimal energy imparted, and other ones which require much more energy. The optimal excitation voltage of an easily fragmentable ion and a poorly fragmentable ion of the same mass may well differ by a factor of 6. The optimum of the best excitation voltage is relatively sharp: slightly too little or too much voltage may even cause no fragmentation or—for reasons which are not fully understood yet no collectable daughter ions, possibly because the parent ions hit the end cap electrodes of the ion trap prior to their fragmentation.

Automation of the scanning of daughter spectra (and granddaughter spectra) in ion traps therefore becomes practically impossible, or at least exceptionally difficult. Graduated trial and error to achieve optimal fragmentation voltage is usually impossible because there is insufficient time.

Even within a group of similar substances—as for example the peptides—optimal fragmentation of the ions is still considerably dependent on the (usually still unknown) composition and structure of the ions. In addition, there is also an increase in the optimal excitation voltage as the mass of the ions increases, which superimposes itself on the structural difference. It can be explained by the fact that the energy is distributed over more degrees of freedom if the molecular ion is larger.

Moreover, the energy has to be supplied in a short time period because as the collected energy increases it is emitted by radiation or dissipated by very low-energy collisions (in the thermal range). Dissipation by radiation has a fixed time constant so the energy absorbed can only take on satisfactorily high levels if the supply of energy takes place within a short period of time. Before the ions of an ion type are fragmented, all the other ions which are in the ion trap are ejected from the trap by a special process so that these ions do not superimpose the spectrum of the daughter ions. This process is called isolation: only the ions to be fragmented are left in the ion trap. Since doubly charged parent ions can also form daughter ions whose mass-to-charge ratio m/e is larger than that of the parent ions, the ions not of interest which are heavier than the parent ions must also be removed, whereby the term "heavier" (as also the term "lighter" used in the following) relates to the mass-to-charge ratio m/e.

Scanning daughter ion spectra has proved particularly successful for investigating peptides in ionization by the electrospray method. The peptides usually stem from a digest of a larger protein due to an enzyme, trypsin for example. These digest peptides cover a mass range m of approx. 500 to approx. 4,000 atomic mass units. However, not only singly charged ions are generated but also ones with two, three, and even four charges. As a general rule of thumb one can say that the center of charge distribution increases by one charge per thousand mass units.

In ion traps it has been particularly useful to apply the doubly charged ions for fragmentation. There are several reasons for this, one of which being the easier fragmentability. However, especially the span between the smallest detectable daughter ion, given by the separation limit $m_a/e$ of the ion traps for light ions, and the largest daughter ion (relative to m/e) is much larger than for singly charged parent ions.

In practice it has proved favorable to not isolate the ions monoisotopically but to leave all the ions of a mass-to-charge ratio with the isotopic companions inside of the ion trap and to fragment them together. This produces the advantage that it is possible to immediately see from the distance between the isotopic peaks whether the daughter ions have one or several charges. Joint fragmentation of all isotopic masses, however, means it is essential to use a frequency mixture for fragmentation. The mixture must cover the frequencies of the ions involved. This might be most simply achieved if for each of the involved ionic types of the same isotopic mass a separate fragmentation frequency were calculated and applied.

Unfortunately the construction of modem ion traps, which necessitates a so-called nonlinear ion trap geometry with superimposition of higher multipole fields for physical reasons which will not be explained here, does not permit a separate fragmentation frequency for each isotopic peak. The oscillation frequency of the ions changes due to the nonlinear field components with increasing oscillation amplitude. Excitation of the ions must therefore "switch over" from an initially effective excitation frequency with oscillation amplitude increasing to an adjacent frequency. This switchover in turn only succeeds if the two adjacent excitation frequencies are in phase.

A frequency mixture can only consists of individual discrete frequencies with a discrete frequency spacing. The smaller the frequency spacing, the longer it takes for two adjacent frequencies to come into phase, without which the switchover is not possible. In other words, at a frequency spacing of 250 hertz between two adjacent frequencies the frequencies are in phase exactly every four milliseconds. Consequently, a switchover is possible every four milliseconds. If the spacing is closer at 100 hertz, the switchover is only possible every ten milliseconds. Fragmentation with a frequency mixture is known from GB 2 291 534 (U.S. Pat. No. 5,528,031). The problems of switching to adjacent frequencies are explained in GB 2 297 192 (U.S. Pat. No. 5,654,542).

The fragmentation must take place in such a way that the daughter ions, the masses of which are always lighter than those of the parent ions, can be collected in the trap. Fragmentation must therefore be performed at an RF amplitude which is far away from the amplitude for the lower threshold limit for ion storage. Generally three times the amplitude value for the threshold old limit $m_a/e$ is used, i.e. all the daughter ions the m/e of which is between one third and the full m/e of the parent ions, can be collected in the ion trap and measured as a spectrum. On account of the RF amplitude the oscillation frequency of the parent ions and therefore the excitation frequency is determined for their fragmentation. A favorable value for fragmentation in an ion trap, which operates at a thrust frequency of approx. 800 kilohertz, is, for example, 75 kilohertz. If for ions with a mass of 1,000 atomic mass units fragmentation is to detect about 10 masses, the mixture must have a frequency width of about 750 hertz.

At a mass of 1,000 atomic mass units an isotope group has about four measurable isotopic lines at 1,000, 1,001, 1,002, and 1,003 atomic mass units. If there is an increase in the amplitude of their oscillations in the z direction, the ions change their oscillation frequency by an amount which corresponds to approx. two to three mass units. If one also takes into consideration the accuracy of calibration, one arrives at a desirable width of excitation amounting to approx. 10 mass units.

An optimal fragmentation consists in fragmenting about 80% to 100% of the parent ions in as short a time as possible. It turns out that for this purpose the application of four frequencies with three spacings each of 250 hertz is more favorable than the application of eight frequencies, for example, with seven spacings each of 100 hertz, which probably has to do with the above-mentioned switchovers. Although the isotope frequency is slightly distorted during fragmentation, the time required for optimal fragmentation is much shorter. Assuming that the excitation amplitude is set optimally, fragmentation takes only about 40 milliseconds, so it permits about ten switches to an adjacent frequency. At a frequency spacing of only 100 hertz, only four switches would be possible in the 40 milliseconds; but a larger number of switches would be necessary due to the smaller frequency spacing.

OBJECTIVE OF THE INVENTION

It is the objective of the invention to find a method which, without extending fragmentation time, makes it possible to fragment as optimally as possible ions with very different structures without having any prior knowledge of the most favorable voltage exciting the ions for fragmentation.

SUMMARY OF THE INVENTION

The invention consists of applying the fragmentation amplitude of the axially exciting voltage not constantly over the entire fragmentation time at an optimal value but ramping that fragmentation amplitude from small values to large values without extending the usual fragmentation time. One variant consists of selecting quite a high fragmentation amplitude, initially for a very short time, and then scanning the fragmentation voltage from small values to large values.

Surprisingly it has been established that a ramp in fragmentation amplitude which commences at about one third of the average value of the fragmentation amplitude for ions of this mass and runs up to double the average value in the customary fragmentation time, simultaneously achieves very good fragmentation results for ions with very different structures. The fragmentation yields are only slightly below those which are found for an optimal, constantly applied fragmentation amplitude. It is not yet understood why this ramp, which for each individual ionic type provides the optimal amplitude only for a very short time, produces such favorable results. For different groups of analytes, such as peptides or artificial polymers, the optimum range of ramping may be lower or higher than given above; the ramping may increase the initial voltage by factors between two and ten.

The ramp may be increased linearly or exponentially. Other ramp shapes, for example, compounded from a number of linear rises, can also be selected.

Initial and ultimate values of the ramp can be selected to be dependent on the mass and charge of the ions, according to the dependence of the average fragmentation amplitude on the mass or charge.

For ions of known structure families, e.g. peptides, ramps can be specially configured, for example, by restricting the extent of the ramp or by creating special ramp shapes.

FAVORABLE EMBODIMENTS

Figure 1:
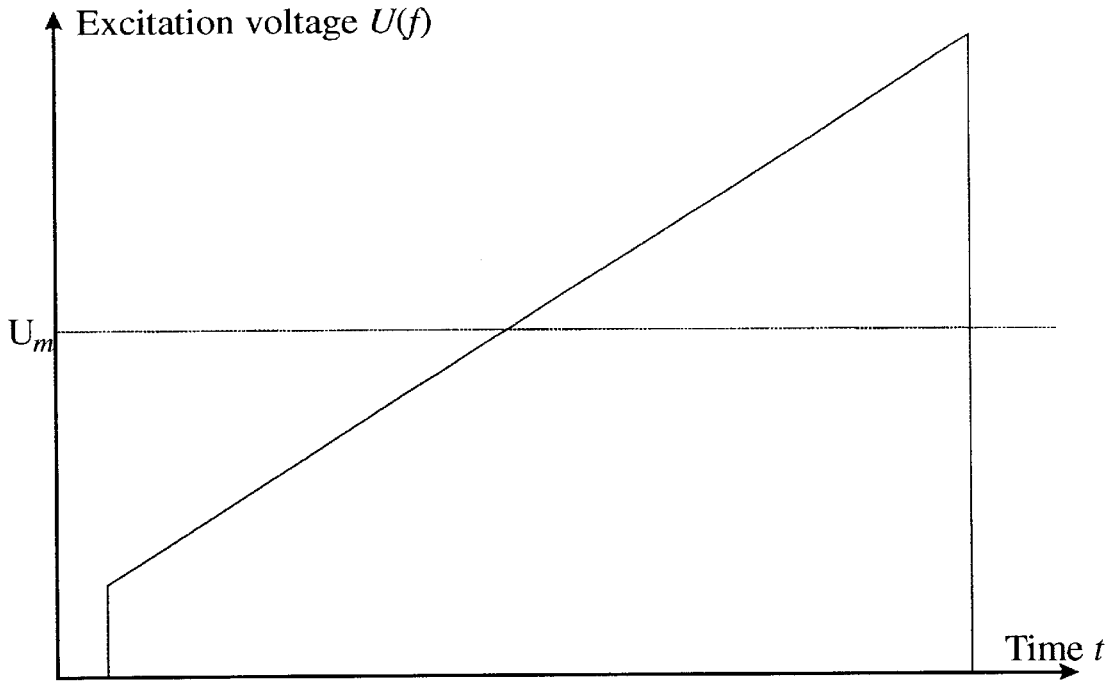
FIG. 1 describes fragmentation voltage (excitation voltage) as a function of time in the form of a linear ramp. $U_m$ is a fragmentation voltage for the stationary case which is optimal on average over many ionic types of the same mass.

A favorable embodiment of the method can be described as follows:

Firstly the ion trap is filled with ions, generally with a mixture of several ion types of different masses, charges, and isotopes. Since for scanning with its sequential ejection of the ions an optimal number of ions must not be exceeded, or else the resolving power suffers due to space charge influences, the ion trap is filled with ions so that after isolation and fragmentation lastly the correct quantity of ions remains. The temporary overcharging with ions is not damaging. The overfilling of the ion trap which is necessary initially can be calculated by a method described in U.S. Pat. No. 5,936,241.

Then the isotope group of the ions to be investigated, that is, of the required parent ions, is isolated by known methods. In doing so it is assumed that the ions are doubly charged ions with a mass of 1,000 atomic mass units (amu), which therefore have a mass-to-charge ratio (m/e) of 500 amu/e. The isotope group is essentially comprised of four isotopic masses with the m/e values of 500.0, 500.5, 501.0, and 501.5 amu per elementary charge e.

With a calibratable setting of the RF drive voltage of the ion trap, the oscillation of the ions in an axial direction of the ion trap is set so that they oscillate at about 75,100, 75,175, 75,250, and 75,325 kilohertz. Now a mixture of four frequencies is applied for a total of 40 milliseconds: 75,000, 75,250, 75,500, and 75,750 kHz. The resonance curves of the ions with these frequencies widely overlap. An average voltage for fragmentation of ions of this mass is about 3 volts. According to this invention this voltage of the mixture is now not applied constantly but is run up linearly from about 1.0 volts to 6.0 volts in these 40 milliseconds. Irrespective of the ion structure this produces good fragmentation for all the ions, whereby about 5% to 10% of the parent ions remain and the rest appear as daughter ions in the m/e range of about 150 to 1,000.

The ions appearing above an m/e of 500 must all be singly charged; the daughter ions appearing below that threshold can have double charges or single charges. However, the charge is easily recognized from the spacing between the isotopic lines; for singly charged ions the spaces are 1 amu each while for doubly charged ions they are ½ amu.

The mixture of frequencies is preferably generated digitally, as already described in GB 2 297 192 (U.S. Pat. No. 5,654,542), whereby the amplitudes of the mixture are stored as digital values over a repeat cycle. At the end of the repeat cycle all the phases of the individual frequency mixture components must be identical to their phase from the beginning of the cycle in order to be able to repeatedly output the stored mixture without any phase shifts. This means that only a mixture of frequencies with integer number of cycles each in the repeat interval is possible. The frequency mixture of the repeat cycle can then be repeated any number of times without any disturbances. The frequency intervals determine the length of the repeat cycle. For instance, the frequencies stated above with intervals of 250 hertz produce a repeat cycle of exactly four milliseconds. The mixture of the repeat cycle can then be repeated ten times within a fragmentation time of 40 milliseconds.

Figure 3:
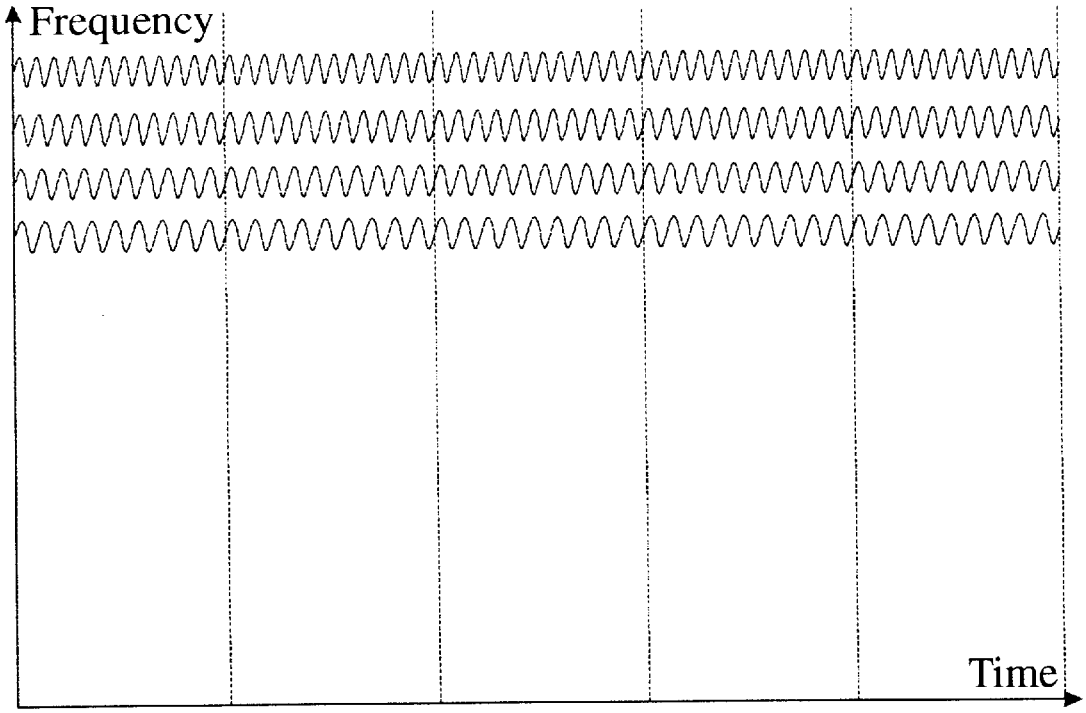
FIG. 3 shows a mixture of four frequencies, the repeat cycles divided up with five broken lines, in which the frequencies each begin and end in phase. To represent the phase relationships the sine-wave curves of the high frequency voltages are shown symbolically, that is, these presentation of frequencies do not represent additional modulations of the frequencies. The figure shows symbolically 9, 10, 11, and 12 sine-wave cycles in a repeat cycle for the mixture; in reality the mixture may consist of, for example, 75,000, 75,250, 75,500, and 75,750 hertz over a repeat cycle of four milliseconds, i.e. 300, 301, 302, and 303 sine-wave cycles. There must be an integer number of cycles in a repeat cycle in order to guarantee phase coincidence at the beginning and end of the repeat cycle. The figure shows a situation in which all four frequencies have the same phase at a point in time (the beginning of the repeat cycle). The times of phase coincidence for two adjacent frequencies in each case may be more advantageously distributed over the repeat interval.

The maximum phases $\cos(\omega t_m)=1$ of the individual RF voltages of the mixture can meet for all the mixture components at a defined time $t_m$ of the repeat cycle, as shown in FIG. 3. However, that is not very favorable because it means that the energy density of the mixture fluctuates considerably in time. It is therefore better to distribute the times for phase coincidence between two adjacent frequencies over the repeat cycle.

The mixture of RF voltages does not have to be applied as a simultaneous superimposition of several voltages. A single RF voltage, the frequency of which is controlled cyclically over the required frequency range, has an almost identical effect. It is then, so to speak, a frequency mixture in the integral of time, not a simultaneously applied frequency mixture. Since the oscillation frequency of the ions in modem, nonlinear ion trap mass spectrometers increases in direct proportion to oscillation amplitude, it is advantageous to also control the excitation frequency in each cycle from smaller to larger frequencies. The rate of change can be adapted to the change in frequency of the ion oscillations. The change in this frequency can preferably be continuous, but it may also be stepwise.

According to this invention the amplitude of the excitation frequency is now ramped up to higher values.

Figure 4:
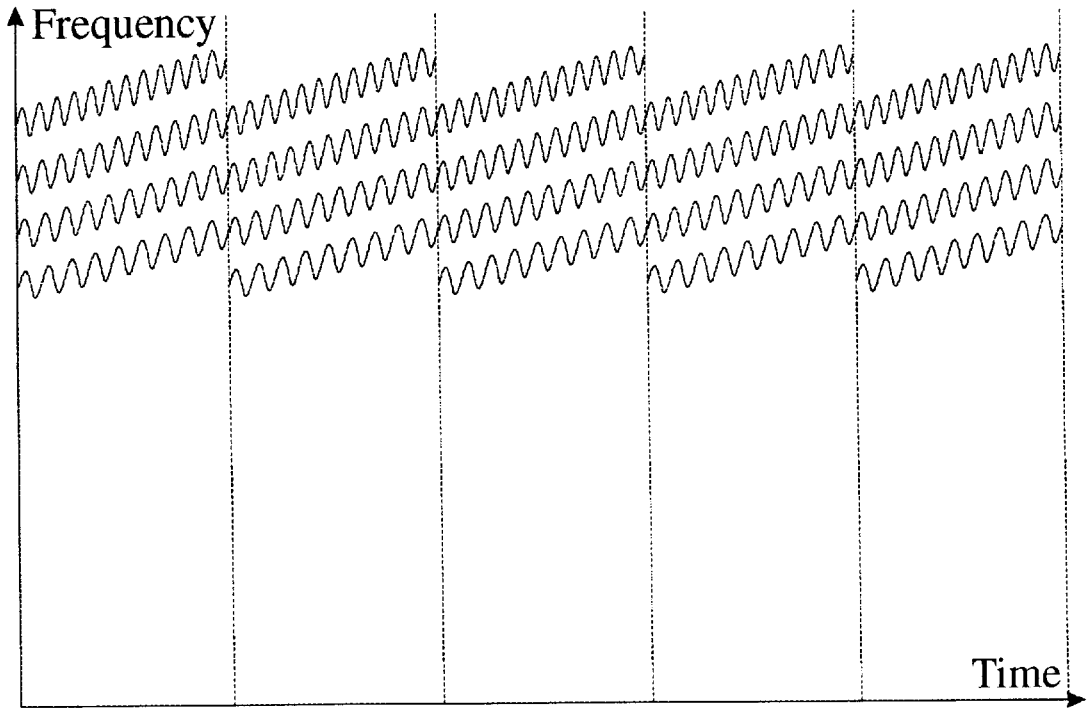
FIG. 4 shows a mixture of four frequencies which rise in the repeat cycle, each to the starting value of the adjacent frequency. These intervals between the frequencies must rise exponentially here in order to be able to satisfy phase coincidence at the beginning and end, which is not clearly evident from the figure.
Figure 5:
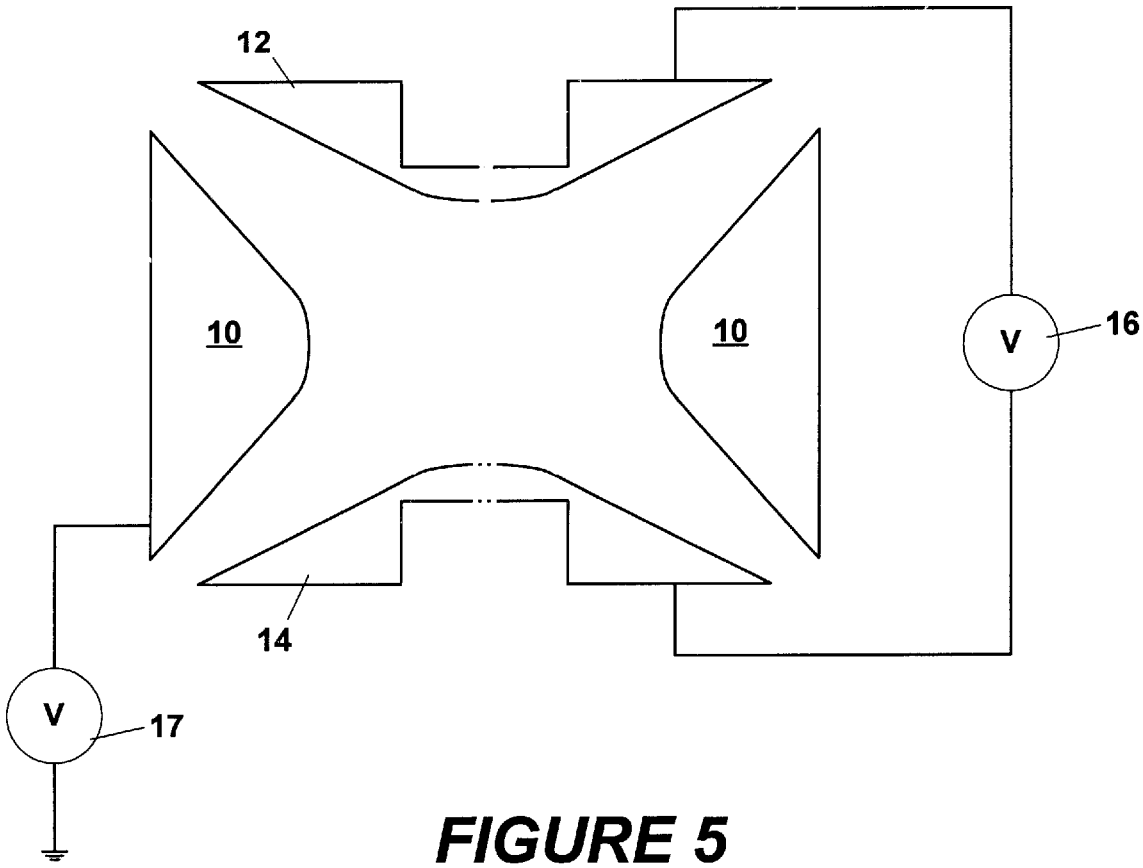
FIG. 5 shows a schematic view of an ion trap mass spectrometer that may be used with the present invention. The ion trap includes ring electrode 10 and end cap electrodes 12, 14. A drive voltage 17 is connected to the ring electrode 10 and an excitation voltage 16 is applied to the end cap electrodes 12, 14.

A different embodiment is to superimpose several frequencies in the mixture but to make each of the frequencies rise or fall so that at the end of the repeat cycle they are identical to the next adjacent frequency in terms of phase and frequency, as indicated in FIG. 4. The frequency rise or fall must in this case be exponential and the frequency intervals must be staggered exponentially in order to be able to finish off in phase; the frequency intervals are now slightly different, the differences of which are, however, so small that they are not apparent from the symbolic representation in FIG. 4. After a repeat cycle of this mixture the highest frequency (or in case of falling frequencies, the lowest) of the mixture is replaced at the end of the repeat cycle by the smallest (highest) frequency again, so that the average of the frequencies remains roughly constant, as can be seen from FIG. 4. Consequently, there is an almost "helical" rise in all the frequencies, which offers an excellent excitation of ions for fragmentation because only little switching to adjacent frequencies becomes necessary. The ion oscillation beats otherwise occurring are much weaker here.

So far in experiments a voltage ramp with a linear rise has been used successfully. However, it is to be expected that an exponential voltage ramp will produce even better results because here the rate of change is always proportional to the level of voltage applied.

Figure 2:
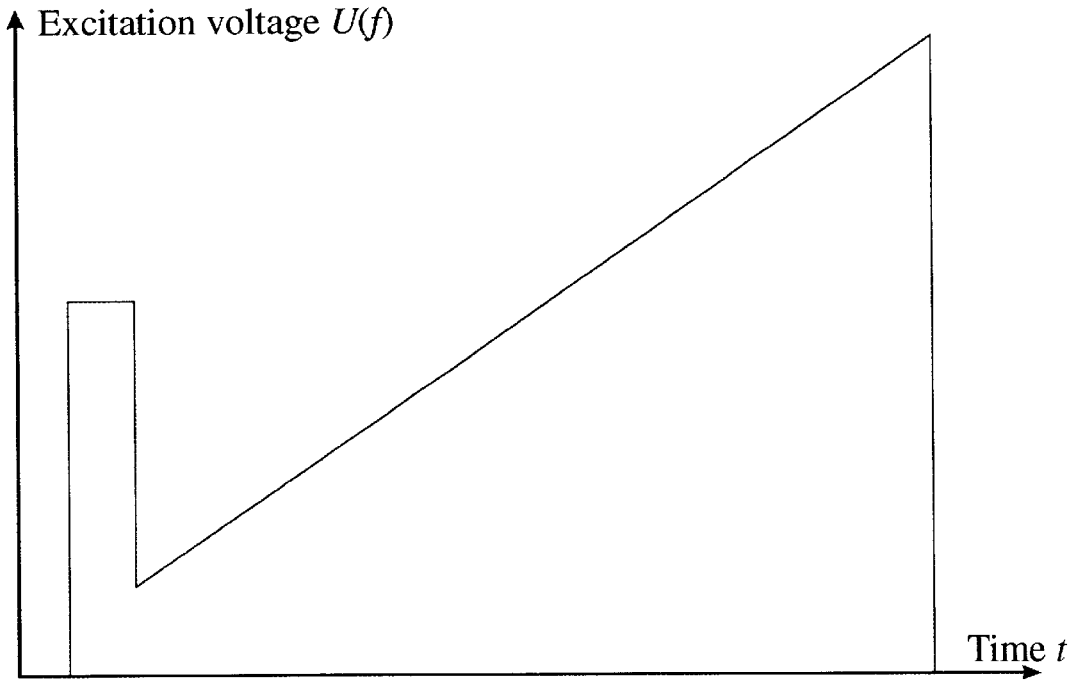
FIG. 2 describes a linearly rising ramp which begins with a pulse of relatively high voltage.

It is to be expected that a relatively short preliminary pulse with a high initial voltage before the voltage ramp proper will lead to a good result. The preliminary pulse could be about one tenth of the fragmentation time in length, that is, about four milliseconds in length, as shown in FIG. 2.

In order to accelerate fragmentation, it is particularly favorable to increase the density of the collision gas during the fragmentation cycle. Normally the collision gas is applied to damp the oscillation amplitudes of the ions in the ion trap in order to compact them into a small central cloud and so increase the resolving power of the spectra when the ions are being ejected. This collision or damping gas normally has a density which only leads to a collision every ten to twenty ion oscillations. If the pressure of the collision gas is increased by a factor of two to four, the fragmentation is also increased by these factors. However, the pressure for an optimal scan and also for optimal isolation has to be reduced again. The pressure can, for example, be increased by a fast switching valve. The switching valve can, for instance, also be used to improve ion collection of the ions, which are normally generated externally, inside of the ion trap.

For very large molecules it is particularly favorable to introduce a collision gas with a heavy molecular weight because then the individual impacts can supply much more energy than the helium which is usually used for damping. For example, nitrogen, argon, xenon, or krypton can be supplied. Simple monoatomic or diatomic molecules produce a better effect than multi-atomic molecules because the latter can easily absorb a portion of the collision energy as internal energy. This collision gas can either be supplied only in the fragmentation cycle or it can also be permanently present inside of the trap.

With these descriptions of the idea of the invention it will be easy for any specialist in the field of ion traps to find and apply other favorable embodiments of this invention.

What is claimed is:

1. Method for optimal collisionally induced fragmentation of selected parent ions in an ion trap filled with collision gas, comprising the following steps:

a) collecting ions within the ion trap, b) isolating the selected parent ions, c) applying a drive voltage to a ring electrode of the ion trap such that the parent ions oscillate in a preselected range of secular frequencies, d) applying an excitation voltage to end cap electrodes of the ion trap in order to resonantly excite the axial oscillations of the parent ions, the excitation voltage comprising a simultaneous application of a mixture of different discrete frequencies in a predetermined frequency range, or a repeating, temporal frequency sweep through said predetermined frequency range, said predetermined frequency range encompassing said preselected range of secular frequencies, but excluding secular oscillation frequencies of daughter ions that result from fragmentation of the parent ions, e) ramping, in an increasing direction, the voltage of the frequency mixture for the excitation during a fragmentation time, and f) switching off the excitation voltage after the preselected fragmentation time.

2. Method according to claim 1, wherein the frequency sweep comprises a cyclic, continuous or stepwise change in the frequency of a single signal component over the predetermined frequency range.

3. Method according to claim 1, wherein the mixture of different frequencies is generated by a superimposition of several high frequency voltages of constant but different frequencies.

4. Method according to claim 1, wherein the mixture of different frequencies consists of a superimposition of several voltages of different frequencies, the frequencies of which are each not constant but increase or decrease continuously during the fragmentation period, whereby the individual frequency voltages each stop at an upper or lower limit of the frequencies and recommence at a lower or upper limit, respectively.

5. Method according to claim 1, wherein the voltage at the end of ramping is about 2 to 10-fold higher than the voltage at the beginning of ramping.

6. Method according to claim 5, wherein the voltage at the end of ramping is about 6-fold higher than the voltage at the beginning of ramping.

7. Method according to claim 1, wherein the ramping of the mixture of voltages is linear.

8. Method according to claim 1, wherein the ramping of the mixture of voltages is exponential.

9. Method according to claim 8, wherein the initial value and ultimate value of the voltage ramp are proportional to the mass of the parent ions to be fragmented.

10. Method according to claim 1, wherein the ramping of the mixture of voltages is preceded by a brief voltage pulse.

11. Method according to claim 1, wherein the parameters of the ramping of the mixture of voltages depend on the mass of the ions to be fragmented.

12. Method according to claim 1, wherein the pressure of the collision gas in the ion trap is increased at least during the phase of fragmentation and is lowered again for scanning.

13. Method according to claim 1, wherein for fragmentation a collision gas is added.

* * * * *